US005305485A

United States Patent [19]

Getz et al.

[11] Patent Number: 5,305,485

[45] Date of Patent: Apr. 26, 1994

[54] CLOTH DETECTION SYSTEM FOR AN AUTOMATIC WASHER

[75] Inventors: Edward H. Getz, Pipestone Township, Berrien County; R. Bruce Sherer, St. Joseph Township, Berrien County, both of Mich.

[73] Assignee: Whirlpool Corporation, Benton Harbor, Mich.

[21] Appl. No.: 350

[22] Filed: Jan. 4, 1993

[51] Int. Cl.[5] ..... D06F 33/02

[52] U.S. Cl. ..... 8/158; 68/12.02; 68/12.04; 68/12.19; 68/196; 68/207

[58] Field of Search ..... 8/158; 68/12.02, 12.04, 68/12.19, 12.21, 12.27, 196, 207; 137/387

[56] References Cited

U.S. PATENT DOCUMENTS

| | | | |
|---|---|---|---|
| 4,170,765 | 10/1979 | Austin et al. | 367/100 |
| 4,199,246 | 4/1980 | Muggli | 354/195 |
| 4,437,497 | 3/1984 | Enander | 141/1 |
| 4,439,846 | 3/1984 | Rodriguez | 367/99 |
| 4,480,449 | 11/1984 | Getz et al. | 68/12 R |
| 4,503,575 | 3/1985 | Knoop et al. | 68/12.18 X |
| 4,675,854 | 6/1987 | Lau | 367/908 |
| 4,697,293 | 10/1987 | Knoop | 68/12.19 X |
| 4,779,430 | 10/1988 | Thuruta et al. | 68/12 R |
| 4,972,386 | 11/1990 | Lau | 367/99 |
| 5,042,276 | 8/1991 | Kamano et al. | 68/12.04 |
| 5,159,823 | 11/1992 | Fukuda et al. | 137/387 X |

FOREIGN PATENT DOCUMENTS

| | | | |
|---|---|---|---|
| 53190 | 3/1985 | Japan | 68/12.04 |
| 240997 | 10/1986 | Japan | 68/207 |
| 290989 | 12/1986 | Japan | 68/207 |
| 290991 | 12/1986 | Japan | 68/207 |
| 41692 | 2/1987 | Japan | 68/207 |
| 68494 | 3/1987 | Japan | 68/207 |

*Primary Examiner*—Philip R. Coe

*Attorney, Agent, or Firm*—Thomas E. Turcotte; Thomas J. Roth; Stephen D. Krefman

[57] ABSTRACT

An automatic washing machine having an automatic liquid level control system including an ultrasonic transmitting and receiving arrangement. The automatic washer includes a vertical axis tub disposed within a cabinet and further having a rotatable perforate wash basket disposed within the tub for receiving a load of clothes and a quantity of washing liquid. The cabinet includes an openable lid disposed above the tub and the wash basket. A transducer is provided, mounted in the cabinet lid, for operating in a first mode as a transmitter for transmitting a sonic pulse into the wash basket. The transducer operates in a second mode as a receiver for generating an electronic signal responsive to receipt of a sonic echo pulse from the surface of the load of clothes disposed within the wash basket. The height of the load of clothes may then be determined in accordance with the elapsed time between transmission of the sonic pulse and reception of the corresponding sonic echo pulse. The wash basket is controlled to rotate while a plurality of sonic pulses are generated and the corresponding sonic echo pulses are received such that a plurality of clothes load heights values are measured and stored. From the plurality of clothes load height values, an average clothes load height and an average clothes height deviation value may be determined. An optimum quantity of washing liquid may then be determined in response to the calculated average clothes load heights and the average clothes height deviation value.

18 Claims, 6 Drawing Sheets

CLOTH DETECTION SYSTEM FOR AN AUTOMATIC WASHER

BACKGROUND OF THE INVENTION

1. Field of the Invention

This invention relates to an automatic liquid control system for an automatic clothes washing machine. More particularly, the invention relates to an apparatus using ultrasonic sound waves for determining an average clothes load height value and an average deviation value such that an optimum liquid level in the clothes washing machine may be determined.

2. Description of Prior Art

The amount of washing liquid required in an automatic washer for achieving an optimum washing operation is dependent on the clothes load quantity. Accurate clothes load quantity information is necessary therefore, to determine optimum washing liquid volume. Typically, the clothes load quantity is visually determined by the user who then manually selects between several predetermined washing liquid quantities using a manually adjustable liquid level switch.

Various systems have also been developed for automatically determining the clothes load quantity in an automatic washer such that an optimum quantity of washing liquid may be provided. For example, U.S. Pat. No. 5,042,276 discloses a clothes detection means utilizing the inertia of the clothes load for determining the clothes load quantity. A motor is repeatedly energized for rotating an agitator and the clothes load disposed in a wash basket. Between each energization, a pause occurs during which the power supply to the motor is turned off while the speed of the inertial rotation of the agitator is measured to detect the clothes load quantity. The inertial rotation is measured by monitoring the back electromagnetic force created in the motor during the pause. The washing liquid level is then determined from the amount of clothes detected.

In U.S. Pat. No. 4,480,449, an automatic liquid level control is provided which measures the volume of liquid required to be added to a tub to increase the liquid level in the tub by a predetermined increment. The measured amount is compared to a reference amount corresponding to an empty tub. When the measured amount equals the reference amount, the clothes in the washer will be covered and the control terminates introduction of washing liquid into the tub.

The above described methods, however, are relatively costly and complex. It would be advantageous therefore, to develop a system which is relatively less expensive and less complex. Furthermore, it would be advantageous to develop a washing liquid fill system which could accurately determine the clothes load quantity and also account for any significant deviation in clothes load height within the wash basket such as may occur if a pillow or the like is placed in the wash basket.

In the present invention, the inventors contemplate a cloth detection system for an automatic washer utilizing ultrasonic distance measuring system for measuring the quantity of clothes in the wash basket. No prior art teaches or suggests the use of ultrasonic distance measuring systems in an automatic washer, however, ultrasonic distance measuring systems for monitoring the fill level in tanks are well known.

Typically, in these systems, an electroacoustic transducer may be controlled such that it is used alternately as a transmission transducer and as a reception transducer. The electroacoustic transducer is preferably arranged in a container above the highest possible fill level in such a manner that the sonic or ultrasonic pulses transmitted by the transducer strike the surface of the material in the container and the echo pulses reflected at the surface of the material are sent back to the transducer. The excitation of the transducer is by electrical excitation pulses with the frequency of the sonic or ultrasonic wave. The electrical excitation pulses are generated by a pulse generator and applied via a transmission/reception switch to the transducer. The electrical reception signal generated by the transducer in response to the received echo signals are applied via the transmission/reception switch to a processing circuit which determines therefrom the time interval between the instants of transmission of a transmission pulse and the reception of an echo pulse originating from the transmission pulse. This time interval corresponds to the travel time of the ultrasonic wave in the container and is thus an indication of the filling level in the container.

U.S. Pat. Nos. 4,972,386, 4,675,854, and 4,437,497, are all examples of ultrasonic systems for monitoring the fill level within a tank which operate substantially similar to the system described above. None on these patents, however, teach or suggest a system for determining the optimum fill level and then controlling the filling of the tank to the determined optimum fill level. Rather, the systems disclosed in these patents all simply monitor the fill level.

Ultrasonic range finding systems are also well known for use in an ultrasonic range finder camera. U.S. Pat. Nos. 4,439,846, 3,522,764 and 4,199,246 all disclose the use of a sonic range-finder systems in a camera which transmit a burst of sonic energy toward a subject and receives an echo pulse from the subject for determining distance from the transmitter/receiver and the subject. Furthermore, detailed schematic circuit diagrams are shown, in these references, for controlling the ultrasonic transducer utilized within the range finding systems.

From a review of the above described background information, it would therefore appear to be an improvement in the art if a less expensive, more versatile and more accurate system was provided for determining the clothes load quantity in an automatic washer. More particularly, it would be an advancement in the art if a cloth detection system for an automatic washer utilized an ultrasonic distance measuring device for determining the optimum washing liquid level.

SUMMARY OF THE INVENTION

Accordingly, a primary object of the the present invention is to provide an automatic system for determining the optimum quantity of washing liquid in an automatic washer.

More specifically, it is an object of the present invention to utilize an ultrasonic distance measuring system for determining clothes load height in a wash basket and from that information determining optimum washing liquid quantity.

Another object of the present invention is to rotate the wash basket while utilizing the ultrasonic distance measuring such that a plurality of clothes load heights may be obtained.

Still another object of the present invention is to calculate an average clothes load height value and an average clothes load height deviation value and modifying the optimum washing liquid quantity based on both of these values.

Still another object of the present invention is to provide feed back to the user such that an optimum quantity of clothes may be placed in the wash basket.

Still another object of the present invention is to measure the clothes load height using the ultrasonic distance measuring device prior to initiating the delivery of washing liquid into the wash basket such that measuring problems related to condensation are avoided.

The present invention provides an automatic washing machine having an automatic washing liquid level control system including an ultrasonic transmitting and receiving arrangement. The automatic washer includes a vertical axis tub disposed within a cabinet and further having a rotatable perforate wash basket disposed within the tub for receiving a load of clothes and a quantity of washing liquid. The cabinet includes an openable lid disposed above the tub and the wash basket. A transducer is provided, mounted in the cabinet lid, for operating in a first mode as a transmitter for transmitting a sonic energy pulse and directing the sonic energy pulse into the wash basket. The transducer operates in a second mode as a receiver for generating an electronic signal responsive to receipt of a sonic echo pulse from the surface of the load of clothes disposed within the wash basket. The height of the load of clothes disposed within the wash basket may then be determined in accordance with the elapsed time between transmission sonic pulse and reception of the corresponding sonic echo pulse. The wash basket is controlled to rotate while a plurality of sonic pulses are generated and the corresponding sonic echo pulses are received such that a plurality of clothes load heights values are measured and stored. From the plurality of clothes load height values which are measured, an average clothes load height and an average clothes height deviation value may be determined. An adequate quantity of washing liquid may then be determined in response to the calculated average clothes load heights and the average clothes height deviation value.

Other objects and advantages of the present invention may become apparent to those skilled in the Art, upon reference to the accompanying description when taken in conjunction with the following drawings.

DESCRIPTION OF THE PREFERRED EMBODIMENTS

Figure 1:
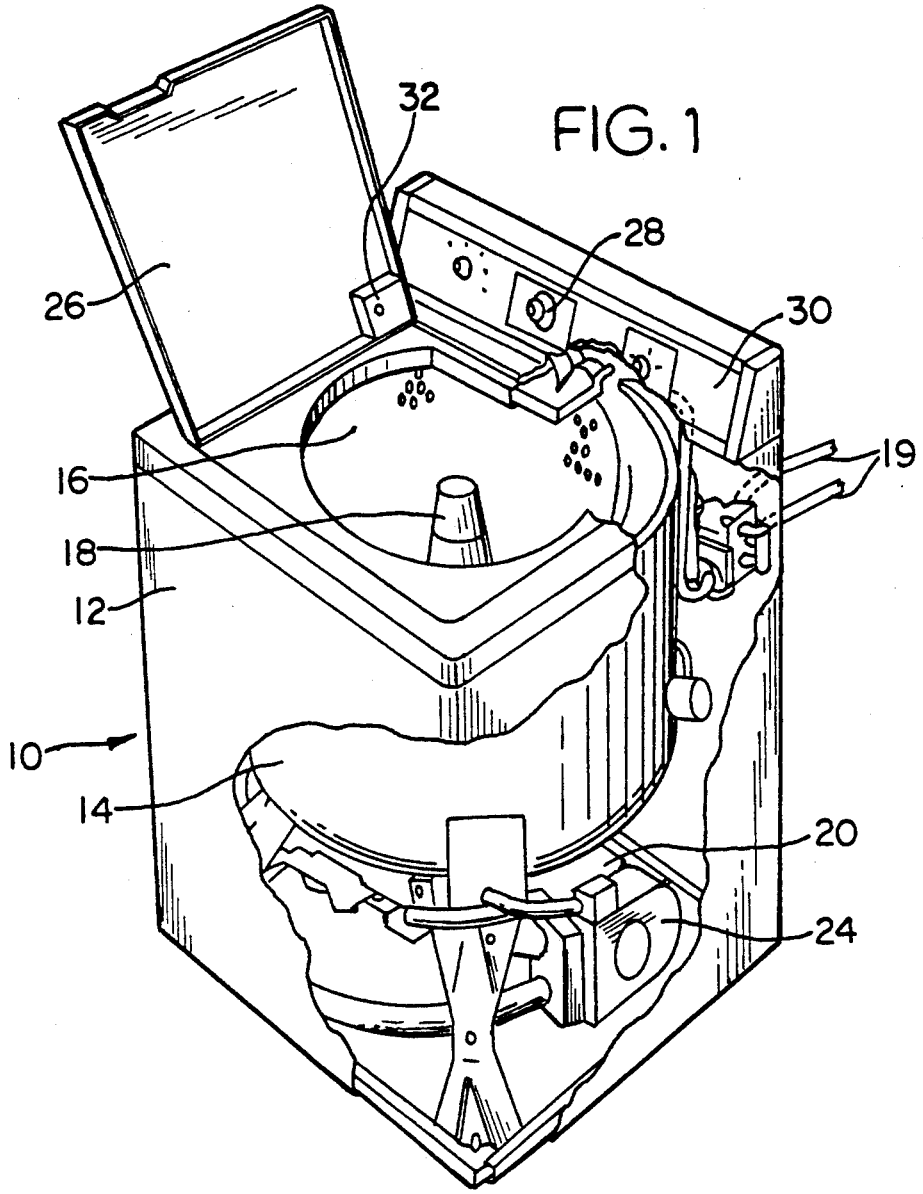
FIG. 1 is a partially cut away perspective view of an automatic washer embodying the principles of the present invention.

In FIG. 1, an automatic washing machine is shown generally at 10 comprising a cabinet or housing 12, and an imperforate tub 14, a concentrically mounted basket 16 with a vertical agitator 18, a water supply 19, an electrically driven motor 20 operably connected via a transmission to the agitator 18 and a pump 24 driven by the motor.

An openable lid 26 is provided on the cabinet top of access into the basket 16. Controls 28 including a presettable sequential control means for use in selectively operating the washing machine through a programmed sequence of washing, rinsing, and spinning steps are provided on a panel 30. An electroacoustic transducer 32 is further provided, disposed on the openable lid 26 of the cabinet. The transducer 32 may be used for automatically determining the optimum washing liquid level as described herein below.

Figure 2:
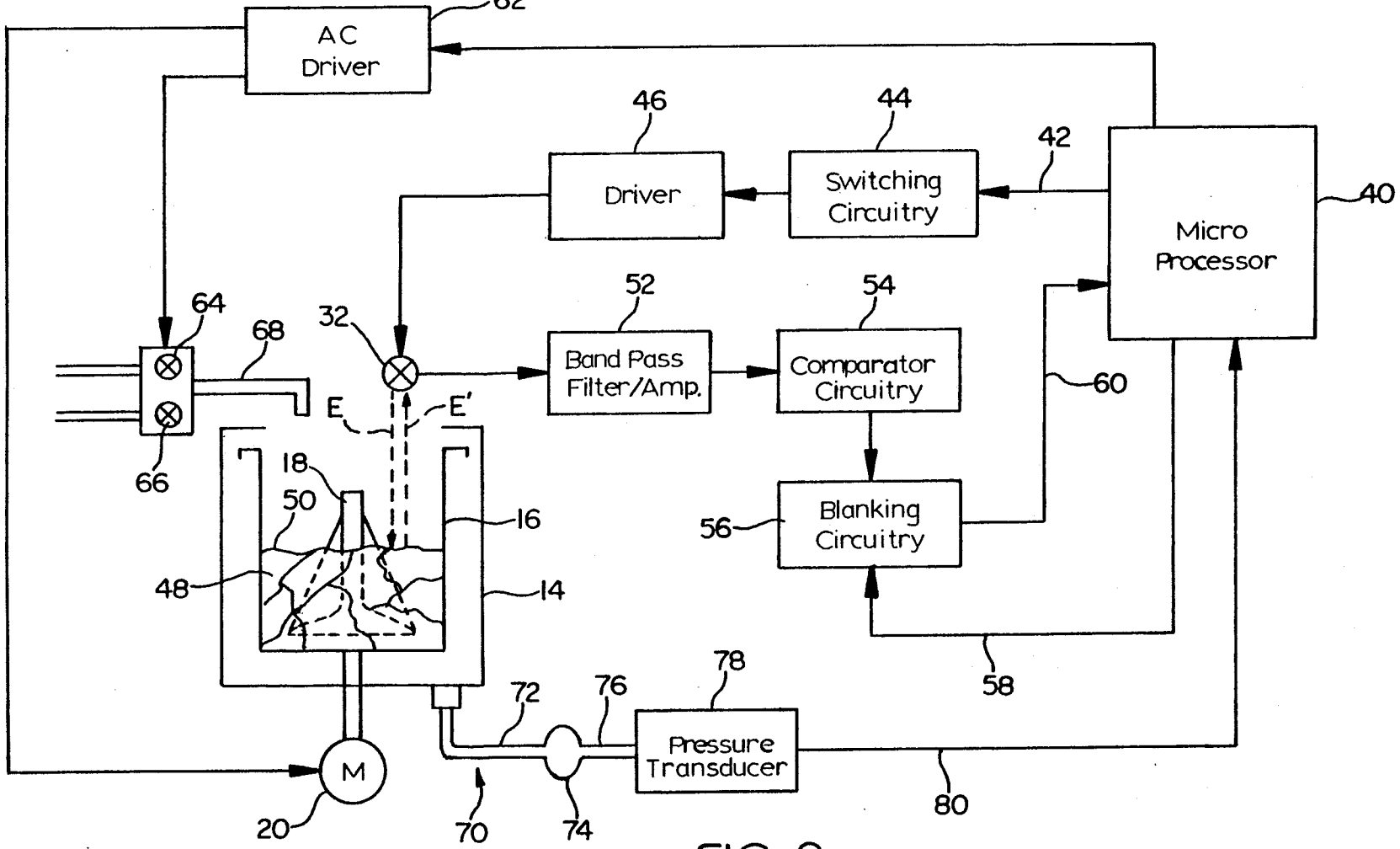
FIG. 2 is a schematic illustration of the automatic washing liquid level control system of the present invention.

FIG. 2 is a schematic diagram showing the system of the present invention for automatically filling the wash tub 14 with washing liquid to the optimum level. A microprocessor 40, such as COP820 manufactured by National Semiconductor, is provided for sending a trigger pulse on line 42 to switching circuitry 44. Within the switching circuitry 44, the trigger pulse is inverted and a voltage pulse is produced. The voltage pulse is directed to a driver 46 which typically includes a transformer for producing a high output voltage pulse or electrical excitation pulse. The electrical excitation pulse is directed to the electroacoustic transducer 32 to produce a burst of sonic energy or sonic pulse E. The burst of sonic energy E is directed downwardly into the wash basket 16 containing a load of clothes 48 having a surface 50. The burst of sonic energy E travels down to the surface at the load of clothes 48 and reflects off of the surface 50 causing sonic echo pulse E' to return to the transducer 32. The transducer 32 serves alternately as a receiver for receiving the sonic echo pulse E' and generating a resultant signal pulse responsive to the sonic echo pulse E'.

The resultant signal pulse is directed to a band pass signal amplifier 52. The signal from the band pass signal amplifier 52 is directed to comparator circuitry 54 which allows only signals whose amplitude exceeds a fixed discriminatory threshold value to pass. The comparator circuitry 54 sends a signal to blanking circuitry 56. The blanking circuitry 56 receives an output pulse blanking signal on line 58 from the microprocessor 40 such that an erroneous triggering of the comparator circuitry by the electrical excitation pulse on line 42 or any noise which results immediately thereafter is not taken for the electronic signal pulse responsive to the sonic echo pulse E'. In this fashion, the transducer may function as transmitter and a receiver. The output of the blanking circuitry 56 on line 60 is a signal corresponding in duration to the distance from the surface 50 of the clothes 48 to the transducer 32.

From the signal, on line 60, the microprocessor 40 may determine the distance from the surface of the clothes load 50 to the transducer 32 and the corresponding required washing liquid level for the optimum washing of the load of clothes 48 disposed in the wash basket 16. The microprocessor may therefore produce output signals to operate an AC Driver 62 which in turn operates solenoids for controlling the functions of mixing valves 64 66.

Upon determining the required washing liquid level, the microprocessor initiates the filling operation. During the filling operation, water enters the wash basket 16 through nozzle 68 and the water level is monitored by a pressure sensor 70. The pressure sensor 70 includes a first conduit 72 interconnected with a chamber 74 and a second conduit 76 interconnected with an electronic pneumatic pressure transducer 78 which provides as an output on line 80 a square wave whose frequency is a function of pressure. From this signal on line 80, the microprocessor may monitor the washing liquid level. The microprocessor 40 therefore is configured to terminate the flow of water through the mixing valves 64, 66 when the water level sensed by the pressure transducer 78 corresponds with the required washing liquid fill level.

As described above, the microprocessor 40 causes the transducer 32 to emit a sonic burst E directed toward the load of clothes 48 disposed in the wash basket 16. A critical feature of the present invention is that the microprocessor simultaneously directs an output signal to the AC Driver 62 for controlling the operation of the motor 20 such that the wash basket 16 is rotated while a plurality of sonic bursts are directed into the wash basket 16. In this fashion, a plurality of clothes load height measurements are made which correspond to the height of that portion of the load of clothes 48 that passes under the transducer 32 when the basket 16 rotates. Preferably, the measurement should take place at equal intervals around the wash basket.

In a manner known per se, the electroacoustic transducer 32, which operates alternately as a transmission transducer and as a reception transducer, can also be replaced by two separate transducers, one of which serves solely as the transmission transducer and the other solely as the reception transducer.

Figure 3:
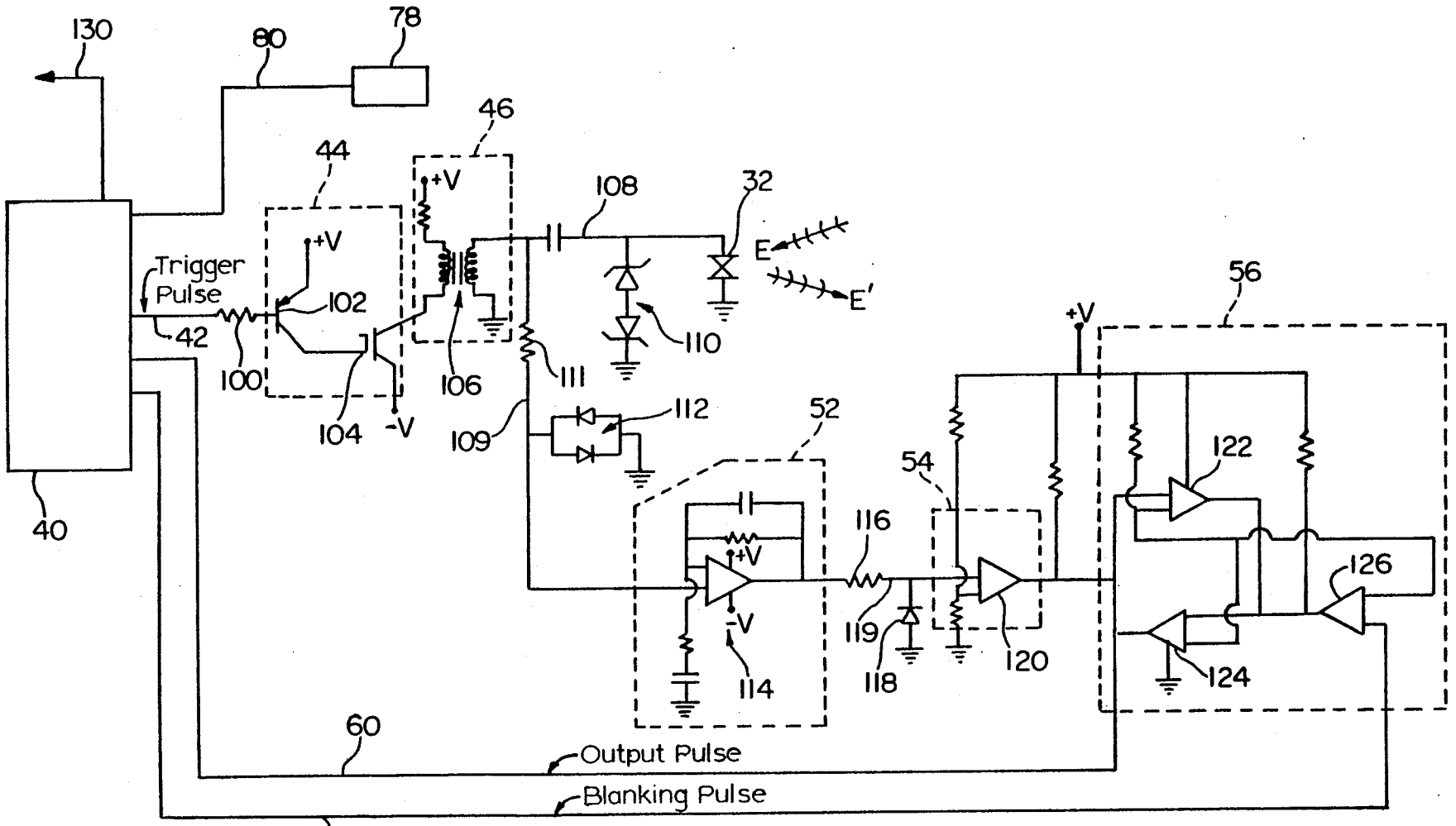
FIG. 3 is a schematic circuit diagram for the automatic washing liquid level control system of the present invention.

Details of the preferred embodiment of the apparatus of the present invention are shown in FIG. 3. The trigger pulse output of the microprocessor 40 is applied through a resistor 100 to the transistor 102. The transistor 102 amplifies and inverts the trigger pulse. The output of the transistor 102 is applied to the gate of MOSFET element 104. The MOSFET element 104 responds to the input from the transistor 102 and applies a signal to the primary of a transformer 106. A high output voltage of the secondary of the transformer 106 is applied along line 108 to the transducer 32. Zenor diodes 110 are provided to limit the output voltage applied to the transducer 32.

The output voltage on line 108 drives the transducer causing it to radiate a highly directional, correspondingly frequency-modulated burst of ultrasonic energy as indicated by arrow E. The sonic echo pulse E' produces the resultant signal pulse in the transducer applied along line 109 to a band pass signal amplifier 114. Decoupling diodes 112 function to decouple the transformer secondary from the band pass signal amplifier 52, the comparator circuitry 54 and the blanking circuitry 56. During the transmission of the high output voltage on line 108 and the transmission of the burst of sonic energy E from the transducer 32, the decoupling diodes are effectively a closed circuit to ground. However, during reception of the echo E' and the generation of the resultant signal pulse, the voltage drop across the diodes create an effect of an open circuit to the resultant signal pulse.

The output of the band pass signal amplifier is applied through a resistor 116 and a diode 118 clamps the signal 119 to ground. A comparator 120 is provided for comparing the signal on line 119 with a predetermined DC voltage. The blanking circuitry 56 is provided for blanking erroneous triggering of the comparator circuitry and receives the blanking signal on line 58 from the microprocessor 40 and comprises a plurality of amplifiers 122, 124 and a comparator 126. The output of the blanking circuitry is applied on line 60 to the microprocessor 40.

The pressure transducer 78 is further shown supplying a signal on line 80 to the microprocessor 40. As described in further detail below, the microprocessor 40 receives the input on lines 60 and 80 and sends a signal on line 130 indicative of the optimum washing liquid level.

Figure 4:
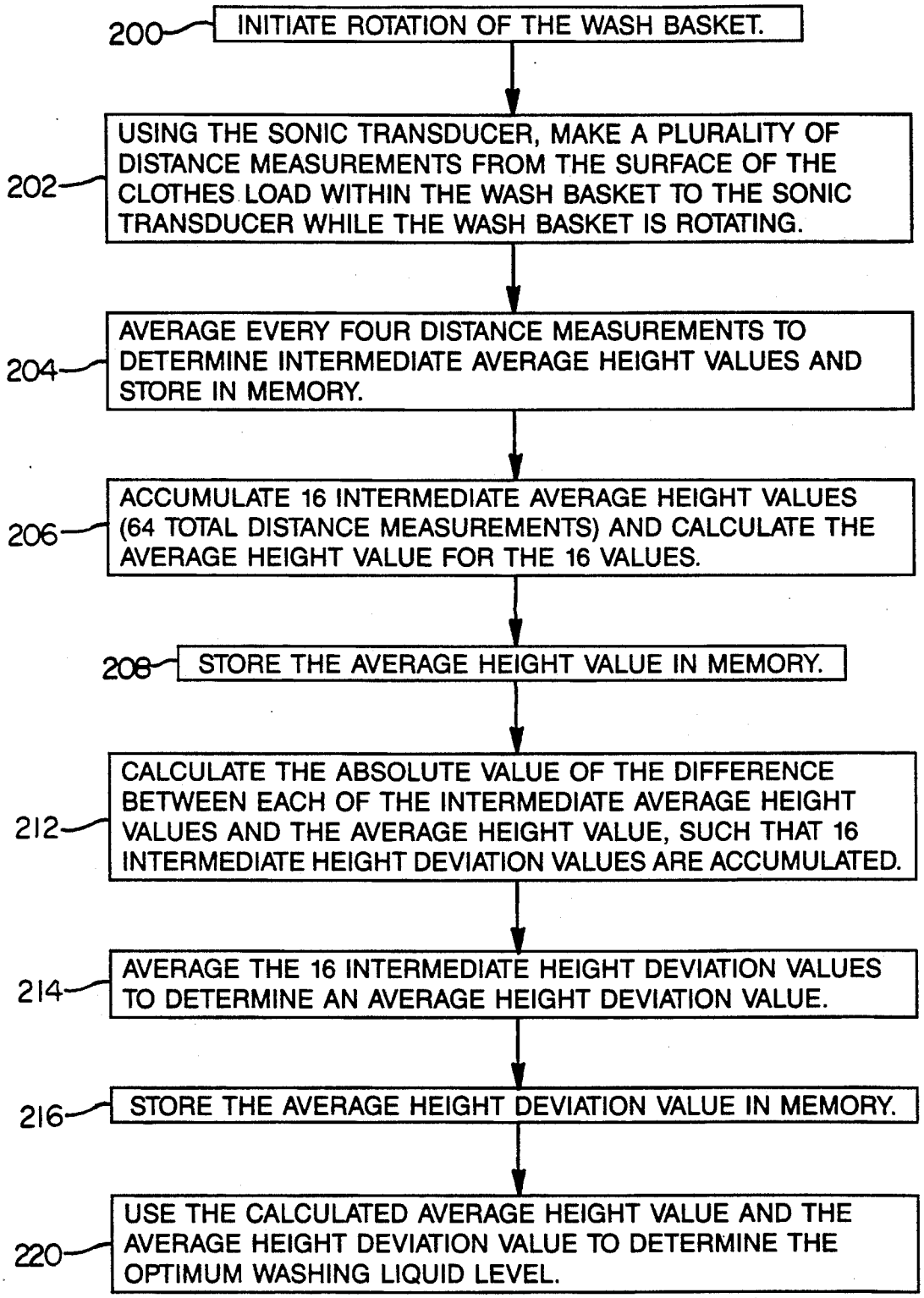
FIG. 4 is a flow chart showing the operation of the automatic washing liquid level control system of the present invention.

FIG. 4 illustrates the operation of the apparatus of the present invention during an automatic cycle of operation. FIG. 4 is in a functional block diagram form, with the various blocks indicating steps performed in sequence during the performance of the present invention.

The first step 200, as mentioned above, is the initiation of the rotation of the wash basket. Preferably the wash basket is rotated approximately 2–3 rotations while a plurality of distance measurements are made from the surface 50 of the clothes 48 to the transducer 32 as shown in step 202. These distance measurements are made in the aforementioned manner.

Steps 204, 206 and 208 illustrate the manner in which an average clothes height value is determined. Every four distance measurements are averaged and stored in a memory register as described in step 204. The average of the four distance measurements are termed intermediate average height values. The next step 206, involves accumulating sixteen intermediate average height values requiring a total of sixty-four distance measurements and calculating an average clothes height value H. The average height value H for the load of clothes is determined from the average of the sixteen intermediate average height values. In step 208, the average height value H is stored in memory.

Steps 212, 214 and 216 illustrate the manner in which an average clothes height deviation value D is determined. In step 212, sixteen intermediate average height deviation values are calculated by taking the absolute values of the difference between each of the sixteen intermediate average height values and the average height value. In step 214, these sixteen intermediate average height deviation values are averaged to determine the average clothes height deviation value D for the load of clothes. In step 216 the average clothes height deviation value D is then stored in memory.

Step 220 covers the use of the average clothes height value H and the average deviation value D in determining the correct washing liquid fill level. The logic behind this step is described below. The average clothes height value H corresponds to the average height of the load of clothes in the wash basket. However, rather than determining the optimum liquid level of washing liquid from only the average height value H, the liquid level is modified by the size of the average clothes height deviation value D. If the average clothes height deviation value D is small, the fill level may be determined based on the average height value H alone. However, if the average clothes height deviation value D is greater than some predetermining minimum, the fill level is modified to be greater than the level which would be determined based on only the average height value H. In this fashion, adequate fill levels of washing liquid are still determined in the presence of large variations in the height of the load of clothes within the wash basket. This may prevent potential clothes damages as well as poor washing results. This logic can be equated to the mental steps required by a user when manually selecting the fill level where the wash load is unevenly distributed in the wash basket such as may occur when washing pillows, blankets or the like.

Figure 5A:
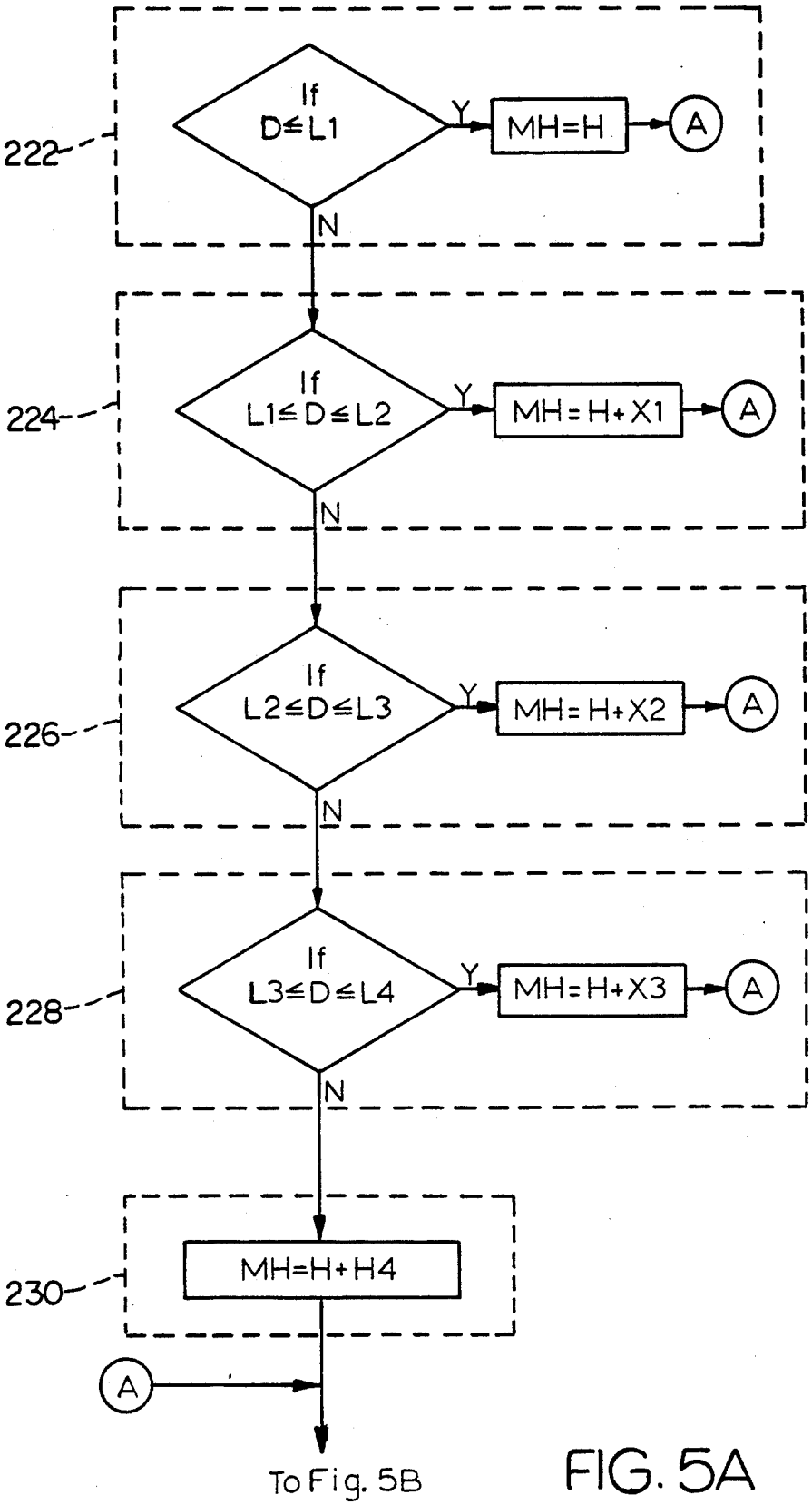
FIGS. 5A and 5B constitute a flow chart showing the logic utilized in modifying the average clothes height value in response to the average deviation value and the logic used to determine the optimum liquid level from the modified average clothes height value.
Figure 5B:
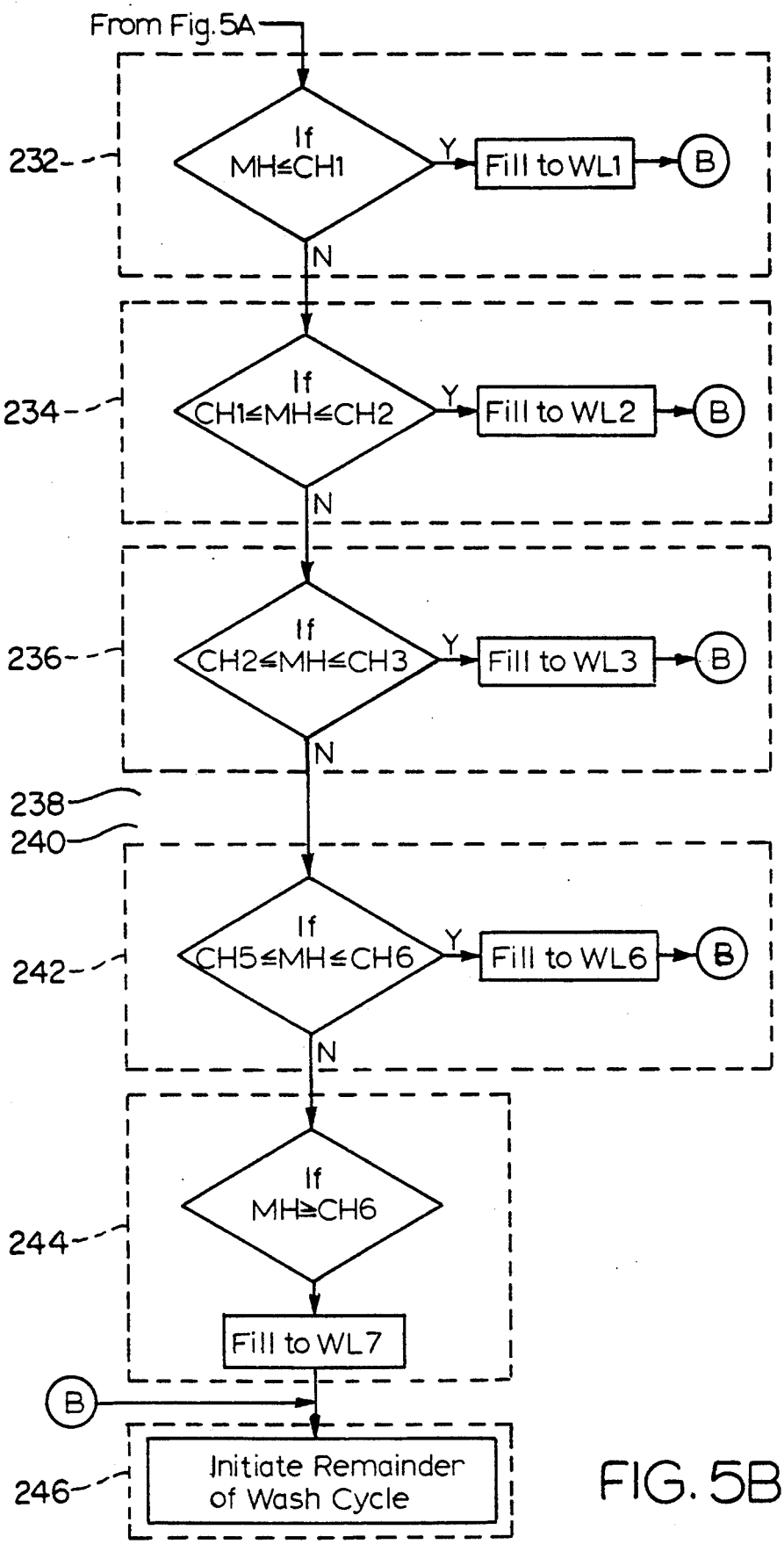

FIGS. 5A and 5B provide further detail and understanding of the steps involved in using the calculated average height value H and the average height deviation value D in determining the correct washing liquid fill level.

FIGS. 5A and 5B detail the logic utilized in modifying the average clothes height H based on the average deviation value D to arrive at a modified clothes height value MH. In step 222 it is shown that if the average deviation value D is less than or equal to a first predetermined quantity L1, then the modified clothes height value MH equals the average height value H. In step 224 if the average deviation value D is greater than the first predetermined quantity L1, but less than or equal a second predetermined quantity L2, greater than the first predetermined quantity L1, then the modified clothes height value MH equals the average clothes height value H plus a first predetermined additional height value X1. It can be seen that this logic continues in step 126 and 228. Finally, if the average deviation value D is greater than a fourth predetermined quantity L4, then the modified clothes height value MH equals the average clothes height value H plus a fourth predetermined additional height value X4.

Steps 232 through 244 illustrate how an optimum washing liquid level WL is determined from the modified clothes height value MH. The pressure transducer 78, as is well-known in the art, is capable of monitoring the level of washing liquid at a predetermined series of washing liquid levels such that the washing liquid level may be controlled to any one of said predetermined washing liquid heights. Therefore, it is necessary to correlate the determined modified clothes height value MD to one of said predetermined washing liquid levels which the pressure transducer 78 is capable of monitoring.

In step 232 of FIG. 5, it can be seen that if the modified clothes height value MH is less than or equal to a first predetermined clothes height value CH1, then the washing liquid level is controlled to a first water level WL1. The first water level WL1 is the minimum fill level possible and is equal to the lowest predetermined washing liquid level which the pressure transducer 78 is capable of monitoring. In step 234 it is seen that if the modified clothes height value MH is greater than the first predetermined clothes height CH1 and less than or equal to a second predetermined clothes height CH2, then the washing liquid level is controlled to a second water level WL2, equal to the second lowest predetermined washing liquid level which the pressure transducer 78 is capable of monitoring. Similar logic steps are shown in steps 236, 238, 240 and 242. In this fashion, therefore, the modified height value MH is correlated to a water level which may be monitored by the pressure transducer. In step 244, if the modified clothes height value MH is greater than a sixth predetermined clothes height value CH6, the washing level is filled to a maximum value. Step 246 indicates that upon completion of fill, the remainder of the wash cycle is initiated.

In this fashion therefore, a novel automatic system for determining the optimum quantity of washing liquid in an automatic washer is provided. More specifically, an ultrasonic distance measuring system for determining clothes load height in a wash basket while rotating the wash basket and further determining the optimum washing liquid level from the clothes height is provided. Still further, a method for determining the optimum liquid level based on the average clothes height value and the average clothes height deviation values is shown.

Although the present invention has been described with reference to a specific embodiment, those of skill in the Art will recognize that changes may be made thereto without departing from the scope and spirit of the invention as set forth in the appended claims.

We claim:

1. An automatic washing machine having a vertical axis tub disposed within a cabinet and a rotatable perforate wash basket disposed within said tub for receiving washing liquid and a load of clothes to be washed therein, said washing machine having a washing liquid level control system comprising:

a sonic transducer for directing a plurality of sonic pulses into said wash basket having said load of clothes disposed therein and further for receiving a plurality of sonic echo pulses from said load of clothes, said sonic echo pulses being the reflections of said sonic pulses from said load of clothes;

means for rotating said wash basket while transmitting said plurality of sonic pulses and receiving said plurality of sonic echo pulses;

means for determining the height of said load of clothes in said wash basket in response to said plurality of sonic echo pulses;

means for determining an optimum quantity of washing liquid in response to said determined height of said load of clothes; and means for supplying said determined optimum quantity of washing liquid to said tub.

2. An automatic washing machine according to claim 1 wherein said cabinet has an openable lid disposed above said wash basket and said sonic transducer is disposed in said openable lid such that rotation of said wash basket causes an annular section of said clothes load to pass under said sonic transducer.

3. An automatic washing machine according to claim 1 wherein said means for rotating said wash basket while transmitting said plurality of sonic pulses and receiving said plurality of sonic echo pulses further comprises means for rotating said wash basket at least two full rotations.

4. An automatic washing machine according to claim 1 further comprising:

means for calculating an average clothes height deviation value from said plurality of sonic echo pulses; and wherein said clothes load height determining means further comprises:

means for calculating an average clothes height value from said plurality of sonic echo pulses.

5. An automatic washing machine according to claim 4 wherein said average clothes height deviation value is used for modifying said average clothes height value for determining said optimum quantity of washing liquid such that large variations in the clothes load height within the wash basket will not result in a less than optimum quantity of washing liquid.

6. An automatic washing machine according to claim 1, wherein said means for supplying said optimum quantity of washing liquid to said tub comprises:

a pressure transducer disposed on said tub for sensing said determined optimum quantity of washing liquid; and a control means for supplying washing liquid into said tub in response to said output of said pressure transducer such that said optimum quantity of washing liquid is supplied.

7. An automatic washer according to claim 1 wherein said clothes height determining means further comprises means for determining the height of said load of clothes in said wash basket prior to supplying wash liquid into said tub for washing said clothes load in response to said plurality of sonic echo pulses.

8. An automatic washing machine having a vertical axis tub disposed within a cabinet and further having a rotatable perforate wash basket disposed within said tub for receiving washing liquid and a load of clothes to be washed therein, said automatic washing machine having a washing liquid level control system comprising:

means for directing a sonic pulse into said wash basket having said load of clothes disposed therein prior to supplying washing liquid into said wash basket for washing said clothes load;

means for receiving a sonic echo pulse from said load of clothes, said sonic echo pulse being the reflection of said sonic pulse from said load of clothes; and means for controlling the supply of washing liquid to said wash basket in response to receiving said sonic echo pulse.

9. An automatic washing machine according to claim 8 wherein said means for controlling the supply of washing fluid to said wash basket further comprises:

means for rotating said wash basket while transmitting said plurality of sonic pulses and receiving said plurality of sonic echo pulses prior to supplying washing liquid into said wash basket for washing said clothes load;

means for determining a plurality of clothes load heights in response to receiving said plurality of sonic echo pulses;

means for determining an optimum quantity of washing liquid in response to said plurality of clothes load heights; and means for supplying said determined optimum quantity of washing liquid to said tub.

10. An automatic washing machine according to claim 9 wherein said means for rotating said wash basket while transmitting said plurality of sonic pulses and receiving said plurality of sonic echo pulses further comprises means for rotating said wash basket at least two full rotations.

11. An automatic washing machine according to claim 9, wherein said means for determining an optimum quantity of washing liquid further comprises:

means for calculating an average clothes height value from said stored plurality of clothes load heights; and means for calculating an average clothes height deviation value from said stored plurality of clothes load heights.

12. An automatic washing machine according to claim 11 wherein said average clothes height deviation value is used for modifying said average clothes height value for determining said optimum quantity of washing liquid such that large variations in the clothes load height within the wash basket will not result in a less than optimum quantity of washing liquid.

13. An automatic washing machine according to claim 9, wherein said means for supplying said optimum quantity of washing liquid to said tub further comprises:

a pressure transducer disposed on said tub for sensing said determined optimum quantity of washing liquid; and a control means for supplying washing liquid into said tub in response to said output of said pressure transducer such that said optimum quantity of washing liquid is supplied.

14. An automatic washing machine according to claim 8 further comprising:

a sonic transducer for transmitting and receiving said sonic pulse.

15. An automatic washing machine according to claim 14 wherein said cabinet has an openable lid disposed above said wash basket and said sonic transducer is disposed in said openable lid such that rotation of said wash basket causes an annular section of said clothes load to pass under said sonic transducer.

16. In a method for washing a load of clothes in a vertical axis automatic clothes washing machine having a perforate wash basket for receiving washing liquid and the load of clothes to be washed therein, a method for determining the amount of water to be used during a washing cycle comprising:

rotating said wash basket; while transmitting a plurality of sonic pulses and directing said plurality of sonic pulses into said wash basket having said load of clothes disposed therein;

receiving a plurality of sonic echo pulses from said load of clothes prior to supplying wash liquid into said wash basket for washing said clothes load, said plurality of sonic echo pulses being the reflections of said sonic pulses from said load of clothes;

determining an optimum quantity of washing liquid in response to said plurality of sonic echo pulses; and then supplying said determined optimum quantity of washing liquid to said tub.

17. A method for determining the amount of water to be used during a washing cycle according to claim 16 further comprising:

calculating an average clothes height value from said plurality of sonic echo pulses;

calculating an average clothes height deviation value from said plurality of sonic echo pulses; and modifying said average clothes height value in response to said average clothes height deviation value for determining said optimum quantity of washing liquid such that large variations in the clothes load height within the wash basket will not result in a less than optimum quantity of washing liquid.

18. A method for supplying an optimum quantity of washing liquid to be used during a washing cycle of an automatic washer having a vertical axis perforate wash basket disposed with a tub, said method comprising:

rotating said wash basket;

transmitting a plurality of sonic pulses and directing said plurality of sonic pulses into said wash basket having a load of clothes disposed therein;

receiving a plurality of sonic echo pulses from said load of clothes, said plurality of sonic echo pulses being the reflections of said sonic pulses from said load of clothes;

calculating an average clothes height value from said plurality of sonic echo pulses;

calculating an average clothes height deviation value from said plurality of sonic echo pulses; and determining an optimum quantity of washing liquid in response to said average clothes height value and said average clothes height deviation value such that large variations in the clothes load height within the wash basket will not result in a less than optimum quantity of washing liquid; and supplying said determined optimum quantity of washing liquid to said tub.

* * * * *